United States Patent [19]

Holka

[11] Patent Number: 4,530,260

[45] Date of Patent: Jul. 23, 1985

[54] CAN OPENER TOOL

[76] Inventor: Leon G. Holka, P.O. Box 18198, Fountain Hills, Ariz. 85268

[21] Appl. No.: 594,220

[22] Filed: Mar. 28, 1984

[51] Int. Cl.[3] ..... B67B 7/40

[52] U.S. Cl. ..... 81/3.55; D8/40

[58] Field of Search ..... 81/3.46 R, 3.4, 3.34; D8/33, 40, 18, 34

[56] References Cited

U.S. PATENT DOCUMENTS

D. 232,415 8/1974 Matsumoto ..... 81/3.46 R
D. 269,587 7/1983 Hanslmair ..... 81/3.46 R
4,253,352 3/1981 O'Neal ..... D8/40
4,466,313 8/1984 Gardner ..... D8/40

*Primary Examiner*—James L. Jones, Jr.
*Attorney, Agent, or Firm*—Herbert E. Haynes, Jr.

[57] ABSTRACT

An opener tool for aiding a user in opening a can of the type having a self contained stay-on-tab opening system. The opening tool is configured to slide onto the lever end of the can's tab structure to hold it during pivotable movement of the tab structure and to be in bearing engagement with the head of the rivet which attaches the tab structure to the can to utilize the rivet as a fulcrum for the opener tool.

12 Claims, 8 Drawing Figures

CAN OPENER TOOL

BACKGROUND OF THE INVENTION

1. Field of the Invention

This invention relates in general to a tool for opening cans and more particularly to a new and improved opener tool which facilitates opening of cans having self contained opening systems.

2. Description of the Prior Art

For some time now cans, particularly those used in the beverage containing arts, have been provided with user actuated self contained opening systems in the tops thereof to permit the can to be opened without the necessity of employing a conventional opener.

The first type of opening system to achieve wide usage was that commonly referred to as the "Pull-ring" opening system. Briefly, this type of opening system includes a pull-ring which is riveted or otherwise affixed to a scored tear-away closure provided in the top, or lid, of the can. When opening such cans, the user grasps the pull-ring and tears away both the pull-ring and the scored closure, thus forming an access opening in the top of the can. In that the pull-rings are relatively small and the edges of the tear-away closure are very sharp, it is not uncommon for a user to be cut when opening such a can. Although the tear-away effort exerted by a person opening a can of this type is relatively small, sore fingers, broken fingernails, as well as the above mentioned cuts, can result particularly when an individual must open a plurality of such cans, as often occurs, for example, in commercial establishments, and the like. As a result of this, several devices, or tools, have been proposed for use in opening the pull-ring type of cans, with such tools being used in place of a person's fingers. Examples of such openers are fully disclosed in U.S. Pat. Nos.: 3,459,075; 3,460,411; 3,656,375; 4,120,216; and 4,133,228. To the best of my knowledge, none of these opening tools disclosed in these patents have achieved any degree of commercial success.

In addition to the above stated problems, the tear-away pull-ring closure systems have resulted in several other problems which have caused them to fall into disfavor to the extent that some states have passed statutes against their use. The tear-away pull-ring closures are a discardable item and they are causing considerable litter problems, cut feet at beaches, and they have killed many fish in lakes and streams. Some very serious medical problems have resulted due to some users dropping the pull-ring closures into the opened cans and swallowing them during subsequent drinking of the beverages contained in the cans.

As a result of all of these problems and the increasing ban being placed on the tear-away pull-ring closure systems, a newer opening system has been developed which may be referred to as a "Stay-on-tab" opening system. It is contemplated that this newer can opening system will eventually completely replace the tear-away opening systems but this has not fully occurred as yet.

The stay-on-tab opening systems generally include a tab structure which is permanently affixed to the top, or lid of the can, such as by means of a rivet. The tab structure includes an elongated lever end portion and a relatively shorter opener end portion, and a tongue portion by which the tab structure is attached to the rivet. The tab structure is configured so that lifting of the lever end will cause the tab structure to pivotably move about the rivet to move the opener end downwardly toward the surface of the can's lid. Such downward pivotable movement of the opener end of the tab brings it into bearing engagement with a partially scored closure provided in the lid of the can with the result being the breaking of the scored portion of the closure with deformed displacement thereof inwardly into the interior of the can. In this manner, both the tab structure and the deformably displaced closure remain attached to the can with the closure being disposed where it cannot cut a user or cause other problems.

In stay-on-tab can opening systems prior to use, the lever end of the tab structure is disposed in overlaying engagement with the surface of the can's lid, and in some cases is recessed within a depression formed in the lid. In either case, to open such a can, the user must use a fingernail to raise the lever end of the tab a distance which is sufficient to permit gripping thereof so that the opening operation can be completed. The effort required to initiate and complete such an opening operation, as was the case in the hereinbefore described tear-away opener systems, can break fingernails and hurt fingers particularly when a plurality of these cans are being opened. And, some people simply lack the strength needed to use the stay-on-tab opener system.

For these reasons, opener tools have been proposed for use in opening cans having the stay-on-tab opener systems.

One such opener tool is disclosed in U.S. Pat. No. 4,257,287, as including a tab lifting and pulling hook formed on one end of an elongated handle and having a downwardly extending leg which depresses the partially scored closure simultaneously with the force being applied to the tab by the hooked end of the opener.

Another prior art opener tool is disclosed in U.S. Pat. No. 4,373,246, as including an elongated handle with a socket-like structure formed on one end thereof. To use this tool, it is moved into an aligned position and slidingly moved so that the lever portion of the can's tab structure will enter into the socket-like structure a distance which is about half way between the rivet and the extending end of the lever portion. Then, a lifting movement, which is similar to the pivotable movement of the can's tab structure is used to open the can.

As is known, the cans, lids, partially scored closures, the tab structures and even the attaching rivets are all made from a very thin gage aluminum. Due to this, care must be taken to properly apply opening forces on such stay-on-tab opening systems. In the absence of properly applied forces, the tab structure can malfunction, in other words, become distorted or completely torn loose so that it is rendered incapable of completing the can opening operation. When this occurs, the user is stuck with a partially open can from which drinking is impossible, or at least difficult, as determined by the amount of opening which had been accomplished when the malfunction occurred. Further, a partially open can is dangerous to use, in that serious cuts can easily result. To overcome this, the user must find some sort of instrument, such as a screwdriver, which can be safely used to finish pushing the partially scored closure down into the can.

It has been determined that when a person uses his fingers only to open a can having a stay-on-tab opening system, the above described type of malfunction does not occur in most instances. However, due to the increased force applying capability of opener tools, such as the prior art structures discussed above, the malfunction rate can easily increase to unacceptable levels.

The first prior art opener tool described above is an inherently unstable device due to the downwardly extending leg serving as a fulcrum. The leg is pointed which makes it difficult to pull the tab structure in a straight arcuate movement path, and any tool wobble, or other deviation from a substantially straight arcuate tab movement path can cause opener malfunction. This same prior art opener tool can be made without the extending leg fulcrum and the tool is then used to simply pull the tab structure through its arcuate movement path. Such free hand pulling increases the chances of tool wobble, or other misdirected movement forces.

The second prior art opener tool discussed above is inherently more stable than the first prior art opener tool, in that it is resting on the rim of the can to be opened at the beginning of the opening operation and therefore is in the proper position at least at the start of the opening operation. This initial proper starting position in conjunction with a lifting action, rather than a pulling action as in the first prior art opener tool, decreases the chances of tool wobble or other misdirected forces which could cause movement path deviation. However, the lifting forces exerted by this second prior art device are applied approximately half way between the rivet and the extending end of the lever end of the tab structure. In that this second prior art opener inherently increases the leverage an amount which is significantly greater than that which can be applied by a person's fingers, the application of the lifting forces at the half way point on the lever end as described above can easily distort the tab structure to an extent where it is incapable of being used to complete the opening operation, or can completely tear away the tab structure prior to proper opening of the can.

Therefore, a need exists for a new and improved can opener which overcomes some of the problems and shortcomings of the prior art.

SUMMARY OF THE INVENTION

In accordance with the present invention, a new and improved can opener tool is disclosed for use on cans of the type provided with self contained stay-on-tab opening systems. In the preferred embodiment, the opener tool comprises a pair of rigid planar members which are in spaced parallel relationship with respect to each other and are interconnected by a centrally located transverse post means so as to provide an endless groove between the rigid planar members. The depth dimension of the endless groove is determined by the central post and is such that the opener tool can be slidingly moved onto the lever end of the tab structure with the peripheral edges of the planar member being disposed proximate the rivet. The space between the planar members is such that the lever end of the tab structure will fit snugly in the groove to prevent distortion of the lever end of the tab structure during the opening operation. Further, the oppositely facing edges of the peripheral edge of the planar members are beveled so that when the opener is slidingly moved onto the lever end of the tab structure, the peripheral edges of the opener will inherently move up onto the top of the head of the rivet. With the lever end of the tab structure fully contained in the endless groove of the opener tool, distortion or bending of the lever end is prevented during a can opening operation. Also, with the beveled edge of a selected one of the planar members of the opening tool being in bearing engagement with the head of the rivet, the pivotable movement of the tab structure during an opening operation will tend to follow a desired arcuate path rather than being twisted. Further, the rivet will serve as a pivot point, or fulcrum, about which the opening tool 10 is moved during the can opening operation. Therefore, the increased leverage forces exerted by the opener tool will be directly applied axially on the rivet rather than being applied to the lever end of the tab structure and transferred therethrough to the rivet and the tongue as was the case in the hereinbefore described prior art opener tools. By elimination of the force transferring action of the relatively long lever end of the tab structure, the planar alignment between the lever end and the opener end of the tab structure will remain substantially undistorted and the greatest portion of the bending or distortion of the tab structure will take place, as intended, in the tongue by which the tab structure is attached to the rivet.

In the above described preferred embodiment of the can opener tool of the present invention, the endless groove provided between the spaced planar members thereof allows the tool to be slidingly moved into place on the tab structure of the can to be opened with a minimal amount of tool alignment prior to the beginning of the sliding movement. In that the tab structure of the can to be opened may be received at any point in the endless groove of the opener tool, no axial tool alignment is needed, the only alignment required is that the tool be located in a plane which is at an acute angle with respect to the plane of the tab structure of the can to be opened.

In another embodiment, the can opener tool of the present invention includes an elongated pair of spaced apart parallel members which are interconnected by a central post means which provides open transverse slots on the opposite ends of the tool. The slots each have a depth dimension, which is determined by the post means, so that either one of those slots can be straddlingly moved onto the lever end of the tab structure of the can to be opened, with the extending ends of the spaced planar members being disposed proximate the rivet of the tab structure. The oppositely facing edges of the extending ends of the spaced planar members are beveled so that one of the extending ends of the planar members will inherently move onto the top of the head of the rivet when the opener tool is slidingly moved into place on the tab structure. Therefore, the opener tool of this second embodiment will operate in the same manner as the hereinbefore described preferred embodiment. The only difference between the two embodiments is that the can opener tool of the second embodiment requires more preliminary alignment in that its longitudinal axis must be brought into a substantially axially aligned relationship with the tab structure in addition to being moved into the previously discussed angular planar relationship with respect to the tab structure, prior to being slidingly moved onto the tab structure.

Accordingly, it is an object of the present invention to provide a new and improved opener tool for use in opening cans of the type having a self contained stay-on-tab opening system.

Another object of the present invention is to provide a new and improved can opener tool which is configured to minimize the occurrence of distortion and/or complete tearing away of the stay-on-tab prior to full opening of the can.

Another object of the present invention is to provide a new and improved can opener tool which is configured to be slidingly moved onto the lever end of the tab structure of the can opening system in a manner wherein the lever end of the tab structure will be completely contained and held against distortion by the opener tool during the opening operation.

Another object of the present invention is to provide a new and improved can opener tool which is configured to be in bearing engagement with the head of the rivet that attaches the tab structure to the can so that the can opener tool will be guided so as to pivotably move in an arcuate path about the point of bearing engagement and so that leverage applied by the can opener tool during an opening operation will be directly applied to the rivet to minimize distortion and/or tearing away of the tab structure during the can opening operation.

Another object of the present invention is to provide a new and improved can opener tool of the above described character which is provided, in the preferred embodiment, with a spaced pair of planar members which define an endless peripheral groove therebetween for receiving the lever end of the tab structure of the can upon sliding movement of the tool onto the tab structure of the can to be opened.

Another object of the present invention is to provide a new and improved can opener tool of the above described type wherein the outwardly facing peripheral edges of the planar members of the first embodiment of the tool are beveled to inherently move into bearing engagement with the top surface of the rivet of the tab structure upon sliding movement of the tool onto the tab structure of the can to be opened.

Still another object of the present invention is to provide a new and improved can opener tool of the above described character which is provided in a second embodiment with a spaced pair of elongated planar members which define a transverse open slot at each of the opposite ends thereof so that either of these slots will receive the lever end of the tab structure of the can to be opened upon sliding movement of the tool onto the tab structure.

Yet another object of the present invention is to provide a new and improved can opener tool of the above described type wherein the outwardly facing edges of the opposite ends of the spaced planar members of the second embodiment of the tool are beveled to inherently move into bearing engagement with the top surface of the rivet of the tab structure upon sliding movement of the tool onto the tab structure of the can to be opened.

The foregoing and other objects of the present invention as well as the invention itself, may be more fully understood from the following description when read in conjunction with the accompanying drawings.

DESCRIPTION OF THE PREFERRED EMBODIMENTS

Figure 1:
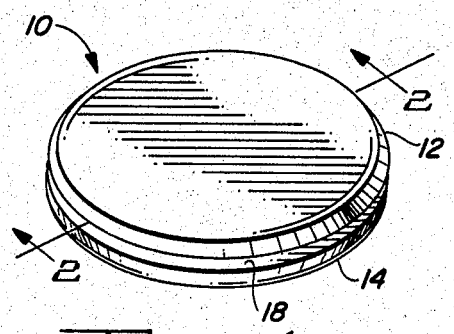
FIG. 1 is a perspective view of a preferred embodiment of the can opener tool of the present invention.
Figure 2:
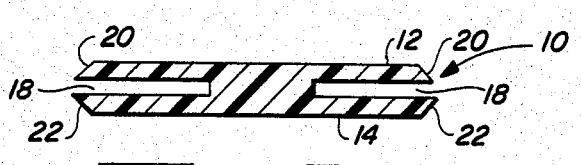
FIG. 2 is a sectional view taken along the line 2—2 of FIG. 1.
Figure 3:
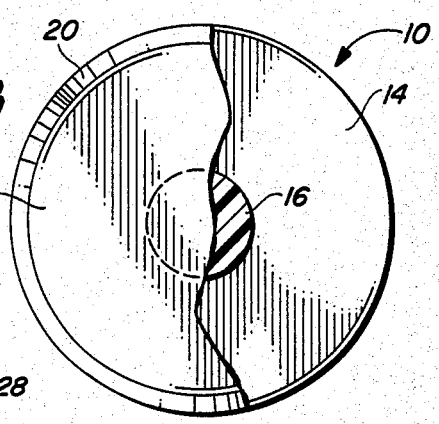
FIG. 3 is a plan view of the can opener tool shown in FIG. 1 which is partially broken away to show the various features thereof.

Referring more particularly to the drawings, FIGS. 1–3 illustrate the preferred embodiment of the can opener tool of the present invention which is indicated generally by the reference numeral 10. The opener tool 10 includes a spaced apart parallel pair of planar members 12 and 14 which are interconnected at their centers by a transverse post 16 which is of reduced size in comparison to the planar members to provide an endless groove 18 between the planar members with the groove 18 opening onto the peripheral edge of the can opener tool 10.

The opener tool 10 may be fabricated of any suitable rigid material, such as metal, but is preferably molded or otherwise formed as an integral one-piece structure of a suitable synthetic resin. The illustrated circular, or disc-shape of the two planar members 12 and 14 is the preferred configuration, however, it will be understood that other non-circular shapes can also be used such as oval, square, and the like.

The oppositely facing peripheral edges of the planar surface members 12 and 14 are beveled as at 20 with respect to the member 12 and 22 with respect to the opposite planar member 14. The purpose for these beveled surfaces will become apparent as this description progresses.

Figure 4:
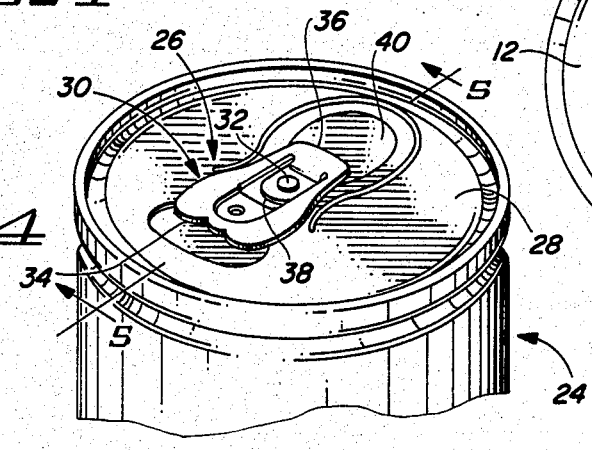
FIG. 4 is a fragmentary perspective view of a can showing the structural details of a typical stay-on-tab can opening system.
Figure 5:
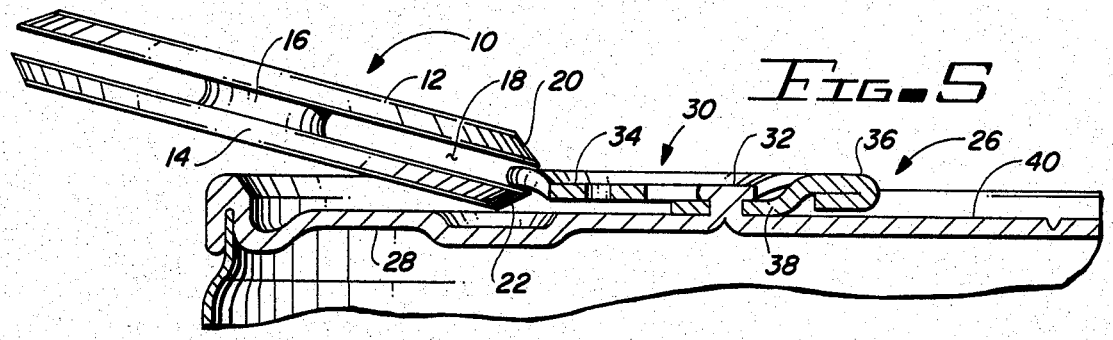
FIG. 5 is an enlarged fragmentary sectional view taken along the line 5—5 of FIG. 4 and showing a fragmentary portion of the can opener tool of FIG. 1 in a starting position preparatory to accomplishment of a can opening operation.

Reference is now made to FIGS. 4–5, wherein fragmentary portions of a can 24 are shown with the can being provided with a self contained opening system 26 of the type herein referred to as a stay-on-tab opening system. This type of opening system 26 is well known in the art and is shown and described herein to insure a complete understanding of the various features and operation of the can opener tool of the present invention. The can 24 has a top lid 28 which is provided with a tab structure 30 that is attached to the lid by means of a rivet 32. The tab structure 30 includes a lever end portion 34 and an opener end portion 36 on the opposite sides of the rivet, with the lever end portion 34 being considerably longer than the opener end portion 36. A tongue 38 extends from the opener end portion 36 of the tab structure 30 with the tongue being secured to the closure lid 28 by the rivet 32. The opener end portion 36 of the tab structure 30 overlays a fully attached end of a partially scored closure 40 which is formed integrally in the lid 28 of the can. The opening operation of this type of opening system is intended to work, in the absence of the can opener tool 10, as follows. First, the user lifts the free end of the lever end portion 34 away from the lid 28, such as with a fingernail, a sufficient distance to enable gripping of the lever end portion. When so gripped, the user pivotably moves the tab structure 30 about a rotational axis which is transverse with respect to the tab structure and is located proximate the rivet 32. When so moved, the opener end 36 of the tab structure will move down into bearing engagement with the partially scored closure 40 and this results in its being ruptured along the score line and deformably displaced downwardly into the interior of the can 24. Due to the forces required to rupture the closure 40, the tongue 38 will become distorted with the remainder of the tab structure 30 retaining its substantially planar configuration. The tab structure 30 will remain attached by virtue of the rivet 32 and the distorted tongue 38 and the ruptured closure 40 will remain attached due to the unscored portion thereof which is proximate the rivet 23. When this part of the opening operation is completed, the tab structure 30 is pivotably moved back to its original position so as not to interfere with emptying of the contents of the can.

In view of the above, it will be appreciated that the opening system 26 is designed to operate in response to the pivotably movements that a user will inherently apply and that the forces should not exceed the amount that an average user would, or could, exert. In other words, if the pivotable movement of the tab structure 30 deviated excessively from its intended arcuate path, i.e., twisted, or the forces exceeds the expected amount, the tongue 38 could be torn loose from the rivet 32, or the remainder of the tab structure 30 could bend to a point where it would be unable to apply the required downwardly exerted forces on the closure 40.

As hereinbefore described, this user accomplished operation is not always as easy to accomplish as it sounds and is not entirely problem free, and when a can opener tool is employed to aid the user, the increased leverage resulting from the tool can easily exceed the forces that can be applied by a user alone and the chances of twisting the tab structure 30 are greatly increased.

Therefore, the can opener tool 10 is designed to eliminate, or at least substantially reduce, the chances of tearing away or distorting the tab structure 30 as a result of the use of an opener tool. The opener tool 10 accomplishes this as an inherent function of its design and operates in the following manner. The can opener tool 10 is placed so that it is in the approximate position shown in FIG. 5, wherein it lies in a plane which is at an acute angle with respect to the plane of the tab structure 30, and the endless groove 18 is proximate the free end of the lever end portion 34 of the tab structure. The tool 10 is then slidingly moved toward the tab structure 30 so that the spaced planar members 12 and 14 straddle the lever end portion 34 of the tab structure. Due to the angular difference between the opener tool 10 and the tab structure 30, the tab structure will be pivotably moved to the position shown in FIG. 6 which is the approximate position that a user would move the tab structure with a fingernail in the absence of the opener tool. When this sliding movement of the can opener tool 10 is being accomplished, the beveled edge 22 of the planar member 14, in the illustrated orientation of the opener tool, will ride up on the extending end of the tongue 38 and on the top surface of the head of the rivet 32. The beveled edge 22 will come to rest on the top of the rivet 32 due to the predetermined depth of the endless groove which is approximately $\frac{3}{4}$ of an inch. Although the opening systems will vary somewhat from one can manufacturer to another, it has been found that the approximate dimension of $\frac{3}{4}$ of an inch will result in the desired final placement position of the beveled edge on the head of the rivet in all can opening systems known to me.

Figure 6:
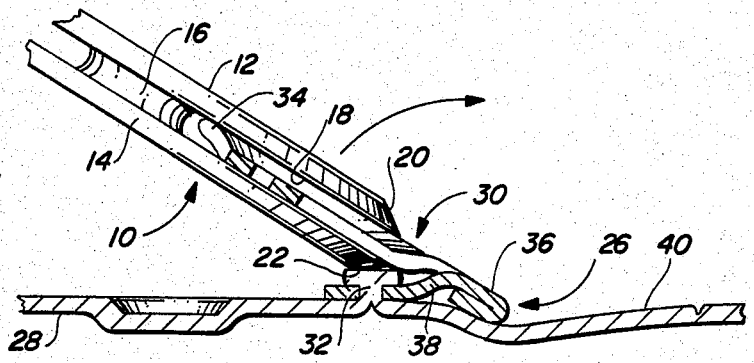
FIG. 6 is a view similar to FIG. 5 and showing the can opener tool as being fully in place at the starting point of the motion required to accomplish the can opening operation.

When the can opener tool 10 reaches this stage in the opening operation, as shown in FIG. 6, the inherent resiliency of the tab structure 30 will tend to hold the beveled edge 22 in contiguous engagement with the upper surface of the head of the rivet 32. This will eliminate, or at least substantially reduce, the occurrence of any deviation, i.e., twisting, in the arcuate movement path of the tab structure. Since the lever end 32 of the tab structure 30 is completely contained in the endless groove 18 of the opener tool 10, it cannot bend. Further, the resting engagement of the beveled edge 22 on the rivet 32 will cause the rivet to act as a fulcrum for the pivotable movement of the opener tool 10. The increased leverage applied by the tool 10 will bear directly on the rivet 32 rather than being indirectly applied to the tongue 38 and the rivet 32 by being transferred thereto through the remainder of the tab structure 30. This, therefore, eliminates or at least substantially reduces the occurrence of the tab structure becoming torn away or distorted due to the use of the can opener tool 10.

Figure 7:
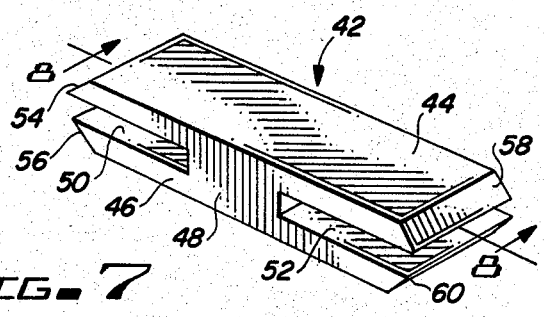
FIG. 7 is a perspective view of a second embodiment of the can opener tool of the present invention.
Figure 8:
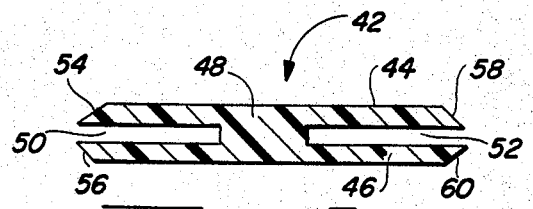
FIG. 8 is a sectional view taken along the line 8—8 of FIG. 7.

Referring now to FIGS. 7 and 8 wherein a second embodiment of the present invention is shown, with the can opener tool of this second embodiment being indicated in its entirety by the reference numeral 42. The can opener tool 42 includes a spaced apart parallel pair of elongated planar members 44 and 46 which are centrally interconnected by transverse post means 48. The post means 48 is sized to provide a pair of transverse slots 50 and 52 on the opposite ends of the opener tool 42 between the spaced planar members 44 and 46 thereof. The transverse slots 50 and 52 open oppositely onto the peripheral surfaces which define the opposite ends of the opener tool 42, and each of the slots are also preferably open sided as shown. The oppositely facing edges of the peripheral end edges of the planar members 44 and 46 are beveled as at 54 and 56 with respect to the slot 50 and as at 58 and 60 with respect to the slot 52. Further, the depth dimension of the slots 50 and 52 are approximately $\frac{3}{4}$ of an inch.

In view of the above, it will be seen that the can opener tool 42 operates in substantially the same manner as the hereinbefore fully disclosed can opener tool 10. There is, however, one difference in the operation. The longitudinal axis of the can opener tool 42 must be brought into substantial alignment with the longitudinal axis of the tab structure 30, in addition to the previously described angular alignment of their respective planes, prior to starting the sliding movement of the opener tool 42 onto the tab structure. Since the use of the tool 42 is otherwise identical to the use of the tool 10, it is believed that repeating of the can opening operation is unnecessary.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An opener tool for use in opening cans of the type having a lid with a scored closure for inward displacement by a tab structure that is attached to the lid by a rivet with the tab structure including a lever end and an opener end, the lever end being adapted for movement in an arcuate path to move the opener end into displacing engagement with the closure, said opener tool comprising:

(a) a spaced apart parallel pair of planar members defining a peripheral edge and a groove means which opens onto the peripheral edge from between said planar members for receiving the lever end of the tab structure when said planar members are moved toward the lever end of the tab structure;

(b) a post means extending transversely between said planar members for interconnection thereof and for defining the depth of said groove means so that at least a portion of the peripheral edge defined by said planar members will be proximate the rivet of the tab structure when the lever end thereof is fully received in said groove means; and (c) at least one of the oppositely facing edges of the peripheral edge defined by said pair of planar members being beveled to guide the peripheral edge into bearing engagement with the head of the rivet of the tab structure when the lever end thereof is fully received in said groove means.

2. An opener tool as claimed in claim 1 and further comprising:

(a) said pair of planar members being configured so that said groove means is endless; and (b) said post means being centrally located between said pair of planar members for defining the depth dimension of said endless groove.

3. An opener tool as claimed in claim 2 wherein said planar members are disc-shaped.

4. An opener tool as claimed in claim 3 wherein the oppositely facing edge surfaces of both of said disc-shaped planar members are beveled.

5. An opener tool as claimed in claim 2 wherein the depth of said endless groove is approximately three-fourths of an inch.

6. An opener tool as claimed in claim 1 and further comprising:

(a) said pair of planar members being of elongated rectangular configuration with the peripheral edge defined thereby being at each of the opposite ends of said planar members; and (b) said post means being centrally located between the opposite ends of said planar members so that said groove means is a pair of transverse slots each opening onto a different one of the opposite ends thereof.

7. An opener tool as claimed in claim 6 wherein the oppositely facing edges at each of the opposite ends of said planar members are beveled.

8. An opener tool as claimed in claim 6 wherein the depth of each of said pair of transverse slots is approximately three-fourths of an inch.

9. An opener tool for use in opening cans of the type having a lid with a scored closure for inward displacement by a tab structure that is attached to the lid by a rivet with the tab structure including a lever end and an opener end, the lever end being adapted for movement in an arcuate path to move the opener end into displacing engagement with the closure, said opener tool comprising:

(a) a spaced parallel pair of disc-shaped structures defining a peripheral edge and an endless groove which opens onto the peripheral edge for receiving the lever end of the tab structure when said pair of disc-shaped members are moved toward the lever end of the tab structure;

(b) a post located centrally and extending transversely between said pair of disc-shaped members for interconnection thereof and for defining the depth of said endless groove so that a portion of the peripheral edge defined by said pair of disc-shaped members will be proximate the rivet of the tab structure when the lever end thereof is fully received in said endless groove; and (c) each of the oppositely facing edges of the peripheral edge defined by said pair of disc-shaped members being beveled to guide the portion of the peripheral edge which is proximate the rivet into bearing engagement with the head of the rivet upon receipt of the lever end of the tab structure in said endless groove.

10. An opener tool as claimed in claim 9 wherein the depth of said endless groove is approximately three-fourths of an inch.

11. An opener tool for use in opening cans of the type having a lid with a scored closure for inward displacement by a tab structure that is attached to the lid by a rivet with the tab structure including a lever end and an opener end, the lever end being adapted for movement in an arcuate path to move the opener end into displacing engagement with the closure, said can opener tool comprising:

(a) a spaced parallel pair of elongated rectangular members defining an opposed pair of ends and a pair of transverse slots each opening onto a different one of said pair of opposed ends, said pair of transverse slots being for selectively receiving the lever end of the tab structure when said pair of rectangular members are substantially axially aligned with the lever end of the tab structure and moved toward the lever end;

(b) a post located between the opposite ends and extending transversely between said pair of rectangular members for interconnection thereof and for defining the depth of each of said pair of transverse slots so that a selected one of the opposed ends defined by said pair of rectangular members will be proximate the rivet of the tab structure when the lever end thereof is fully received in the one of said pair of transverse slots which opens onto the selected one of the opposite ends; and (c) each of the oppositely facing edges of each of the opposed pair of ends defined by said pair of rectangular members being beveled for guiding thereof into bearing engagement with the head of the rivet of the tab structure when the lever end thereof is fully received in either of said pair of transverse slots.

12. An opener tool as claimed in claim 11 wherein the depth of each of said pair of transverse slots is approximately three-fourths of an inch.

* * * * *